US006101781A

United States Patent [19]

Balzer

[11] Patent Number: 6,101,781

[45] Date of Patent: Aug. 15, 2000

[54] BEAM STRUCTURE AND CONSTRUCTIONS USING THE SAME

[76] Inventor: Philippe Balzer, 18, quai Lombard, F-31000 Toulouse, France

[21] Appl. No.: 08/793,972

[22] PCT Filed: Jul. 5, 1996

[86] PCT No.: PCT/FR96/01049

§ 371 Date: Mar. 6, 1997

§ 102(e) Date: Mar. 6, 1997

[87] PCT Pub. No.: WO97/02392

PCT Pub. Date: Jan. 23, 1997

[30] Foreign Application Priority Data

Jul. 6, 1995 [FR] France ..... 95 08487

[51] Int. Cl.[7] ..... E04C 3/20; E04C 3/44

[52] U.S. Cl. ..... 52/724.1; 52/721.1; 52/726.2; 52/737.2; 52/737.6; 52/223.11; 14/6; 14/13; 14/73

[58] Field of Search ..... 52/721.1, 721.2, 52/721.3, 724.1, 724.2, 724.4, 726.2, 737.1, 737.2, 731.1, 737.6, 223.8–223.11; 14/6, 13, 73

[56] References Cited

U.S. PATENT DOCUMENTS

| | | |
|---|---|---|
| 1,701,841 | 2/1929 | Evers et al. . |
| 4,712,344 | 12/1987 | Erdei . |

FOREIGN PATENT DOCUMENTS

| | | |
|---|---|---|
| 456335 | 7/1944 | Belgium . |
| 0 392 142 | 10/1990 | European Pat. Off. . |
| 375178 | 7/1907 | France . |
| 386658 | 6/1908 | France . |
| 849899 | 12/1939 | France . |
| 933097 | 4/1948 | France . |
| 839409 | 5/1952 | Germany . |
| 36 40 578 | 6/1988 | Germany . |

*Primary Examiner*—Robert Canfield
*Attorney, Agent, or Firm*—Young and Thompson

[57] ABSTRACT

A beam structure designed to be subjected to at least one bending load defining therealong an envelope curve of bending moments ($C_1$, $C_2$) comprising at least one first portion in which the bending moments are of a first sign, at least one second portion in which the bending moments are of a second sign opposite to the first, and at least one third portion in which the bending moments are of the first sign or the second sign or are zero. The beam structure includes a first body (11) whose height and length are also those of the beam structure, and a second body (13) joined sideways to the first body (11) along the full length thereof. The second body (13) is at the top of the first body (11) in the first portion of the envelope curve of bending moments and at the bottom of the first body (11) in the second portion of said curve, whereas in the third portion of the envelope curve of bending moments, said second body (13) is longitudinally continuous and arranged in a variable intermediate position between the top and bottom of said first body (11).

20 Claims, 14 Drawing Sheets

BEAM STRUCTURE AND CONSTRUCTIONS USING THE SAME

The present invention relates to beam structures adapted to be subjected to at least one flexure force determining along said beam structure a curve at least of the bending moments, comprised particularly of concrete, a first body whose height and length define respectively the height and length of said beam structure. The technical fields of the invention comprise civil engineering, particularly works of art and hydraulic works, construction, and more generally any field requiring the use of structures resistant to flexure, made of concrete or other known moldable material.

The prior art teaches numerous concrete constructions in concrete or prestressed concrete, comprising or not a metallic core. There is known for example constructions of the square bridge type shown in FIG. 1A or constructions of the multiple beam type interconnected by rough walls as shown in FIG. 2A, or constructions of the bridge type with masts and stays as shown in FIG. 3A.

The dimensions of these works and of the beams which comprise them, as the case may be, are particularly determined as a function of the forces to which they must be subjected in use, comprising their own weight and the variable or permanently applied added weight, thereby permitting determining the envelope curve of the bending moments relative to the construction or to a beam comprising this construction.

For each example of construction given in FIGS. 1A, 2A, and 3A, there is represented in FIGS. 1B, 2B, and 3B, respectively, one of the curves representing the corresponding bending moments by a portion of the construction, for example a curve for the platform and a curve for the abutment in the case of the construction shown in FIG. 3A. For simplification, the variable added loads have not been taken into consideration in the curves of bending moments relative to FIGS. 1A, 2A, and 3A. In all of the present text, for simplification and better comprehension, the abscissae of all the curves of bending moments have been represented in a direction identical to that of the portion of the construction to which it relates, the value O of the bending moments on the ordinates having been positioned on the abscissae, and the bending moments have been given an identical sign for the same force direction, which is to say essentially positive between supports and negative or zero to the supports or to their approaches.

In FIG. 1B, the four curves 1', 2', 3', 4' of the bending moments correspond to the four walls 1, 2, 3, 4 comprising the square bridge with constant cross section shown in FIG. 1A. It will be seen that for the upper wall 1 for example, the bending moments on the curve 1' are maximum in absolute value and of a sign opposite to the supports and in the central portion of the wall farthest from the supports. The curve 1' of the bending moments, which permits computation of the bending constraints which the wall 1 must resist, give rise to a distribution of the principal metallic reinforcements as follows: in the external portion of the square in the region of the supports, and in the lower portion of the wall 1 in the central region farthest from the supports, the metallic reinforcements being distributed in the tensioned portions of a concrete section because of poor resistance to tension of this latter. the same reasoning can be applied to the horizontal wall 3 and to the vertical walls 2 and 4 comprising the square bridge giving rise to a distribution of the principal metallic reinforcements as shown in FIG. 1C.

The example shown in FIG. 1A shows a construction of simple design but of which the resistance is essentially that of the metallic reinforcements disposed principally in the tensioned regions of the construction. This type of construction comprises in fact a large quantity of concrete which does not assist in the strength of the construction, and whose sole object is to clad the metallic reinforcements, thereby giving rise to relatively high cost.

The construction shown in FIGS. 2A and 2C shows a platform bridge of the type with multiple beams interconnected by a rough wall, resting on two abutments and a central pier by means of simple supports, and because of this comprising two spans. The curve of the bending moments relative to the platform is shown in FIG. 2B. Each beam forms with the portion of the rough wall that it supports a structure of T-shape resisting very well span-wise by means of the rough wall acting in compression, but resisting relatively poorly in continuous support, in the case of the central support in which the rough wall is tensioned. Such a configuration requires dimensioning the beams relative to the compressive resistance required in the central support region, such beams thus having initial dimensions in the regions between supports, or at the simple end supports at the level of the abutments at which the bending moment is zero. As a result, such a construction comprises particularly a large quantity of useless concrete which enters almost not at all into the computation of the resistance of the construction and which moreover requires over-dimensioning the resistive parts of the construction because of its weight.

The construction shown in FIG. 3A shows a bridge of the stay type, whose platform rests at one of its ends on a sloping embankment by means of a simple support, in a central portion on a pier, and at its other end on an abutment by means of an anchored support. The two spans thus formed are stayed at their centers. The bending moment curves relative to the platform and the abutment are shown in FIG. 3B. The remarks given in connection with the preceding examples remain true for the example of FIG. 3A, the effect of the stays being similar to continuous supports.

The prior art also teaches bridge structures with beams of variable moment of inertia, particularly beams whose height is great adjacent the continuous supports on piers for example, so as to increase the moment of inertia of the concrete cross section operating in the regions of compression, and low in the central portion of the span in regions of tension. Such structures, which permit concrete operating in compression over the major portion of the transverse sections of the beams, however requires a large quantity of concrete in the region of the continuous supports, and a great height of the construction in this region.

Still further the prior art teaches prestressed or post-stressed concrete constructions whose object is to omit the tensioned portions of the transverse sections by the tension of cables having for the effect to reject the neutral axis beyond the transverse section. It will be noted that these techniques, which permit operating with concrete only in compression and giving rise because of this to a decrease of the weight of the concrete utilized with equal resistance of the construction relative to the reinforced concrete technique, are very costly relative to this latter and because of this are used only in relatively important constructions.

The present invention has for its essential object to overcome the mentioned drawbacks. When one considers the example shown in FIGS. 2A and 2C, which show a construction comprising a plurality of beams of T cross section as is explained above, the applicant has determined that, relative to the curve of bending moments of a beam, the horizontal portion of the T of the beam must be ideally placed in the upper portion of the beam between supports, when the bending moment given by the curve is at a maximum, and ideally placed in the lower portion of the beam in the region of the continuous central support when the bending moment given by the curve is of opposite sign and maximum in absolute value, such that the horizontal portion of the T will be positioned in the compressed region of the transverse sections of the beam. Between the two end positions mentioned above, the horizontal portion of the T can take intermediate positions as a function of the curve of the bending moments.

More precisely, the present invention consists of a beam structure adapted to be subjected to at least one bending force determining along said beam structure an envelope curve of the bending moments which comprises at least one first portion in which the bending moments are of a same first sign, at least a second portion in which the bending moments are of a same second sign opposite said first sign, and at least one third portion in which the bending moments can be of the first sign or of the second sign or zero, said beam structure comprising particularly concrete, at least one first body whose height and length define respectively the height and length of said beam structure, characterized in that said beam structure comprises a second body connected laterally to said first body along the length of said first body, said second body being disposed at an upper end of the height of said first body in the first portion of said envelope curve of the bending moments, said second body being disposed at a lower end of the height of said first body in the second portion of said envelope curve of the bending moments, and in that said second body is continuous longitudinally and disposed in a variable position along the height of said first body, from said high end to said low end in the third portion of said envelope curve of the bending moments.

The determination of the bending moments curve or of the envelope curve of the bending moments applicable to the beam structure according to the invention, permits knowing the end values and these latter as well as their axial positions on the beam structure. Thus, the position of the second body in height relative to the first body will be a function of the bending moments along the length of the beam structure such that the second body will be positioned in the compressed region of a transverse section of the beam structure. More particularly, when the positive and negative bending moments are a maximum or near a maximum in absolute respective value, the second body will be in an end position relative to the height of the first body, which is to say in an upper or lower portion of this latter as will be explained later with the aid of the accompanying figures. When the bending moment is low in absolute value or zero, the second body will adopt for example a mean intermediate position, the flexural constraints being in this case low or zero. Finally, the second body will preferably take a continuous profile, along the structure of the beam, connecting the different end and intermediate positions.

The beam structure according to the invention permits an optimal positioning of concrete acting in compression, in any transverse section of the beam structure, and thus permits considerable lightening in weight of the concrete relative to a beam of the prior art having equivalent resistance, of the order of 40 to 60% in the case of solid slabs for example.

According to a preferred characteristic, said second body is disposed in the middle of the height of said first body in the transverse cross section at which the maximum and minimum algebraic bending moments of the third portion of said envelope curve of the bending moments are on the average low or zero.

According to another preferred characteristic, said second body has, in the third part of said envelope curve of the bending moments a slope of the order of 20%.

The invention will be better understood, and other characteristics and advantages will appear, from a reading of the description which follows of examples of embodiment of a beam structure according to the invention, accompanied by the attached drawings, the examples being given by way of illustration and without any restrictive meaning which can be drawn regarding the invention.

Figure 4A:
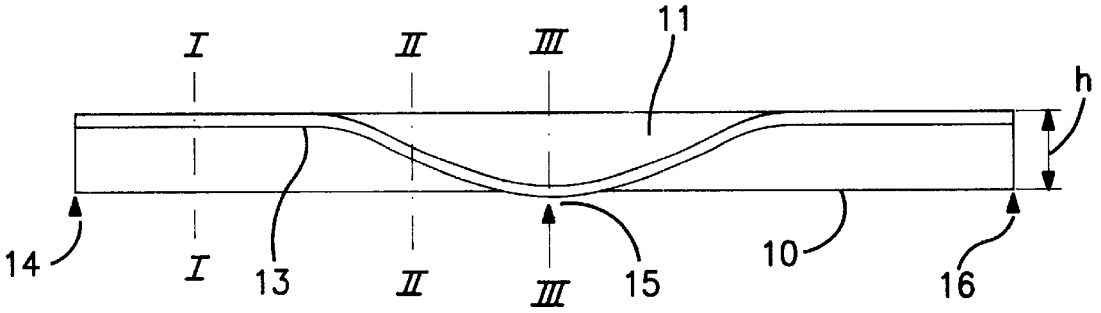
FIG. 4A shows in longitudinal cross section a first example of an embodiment of a beam structure according to the invention.
Figure 4B:
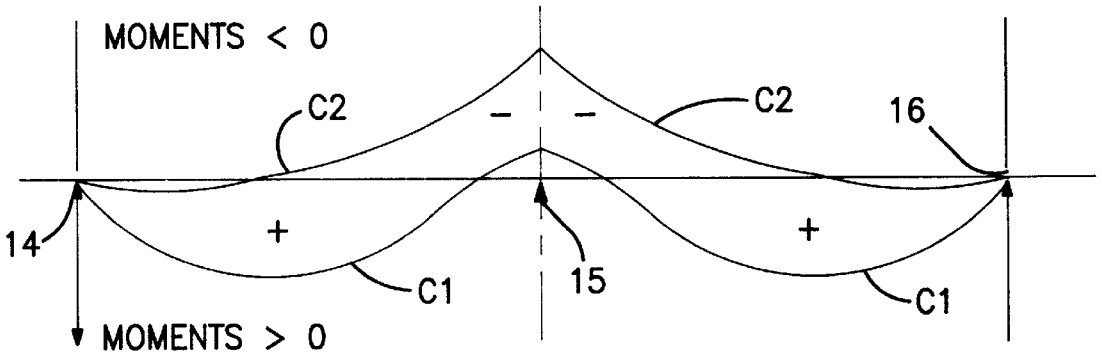
FIG. 4B shows an envelope curve of the representative bending moments applicable to the example of FIG. 4A.
Figure 4C:
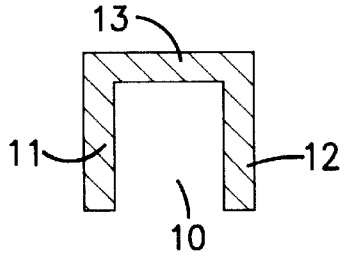
FIG. 4C shows a view in transverse cross section on the line I—I of FIG. 4A.
Figure 4D:
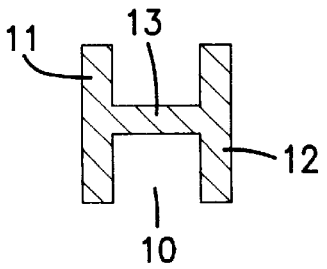
FIG. 4D shows a transverse cross-sectional view on the line II—II of FIG. 4A.
Figure 4E:
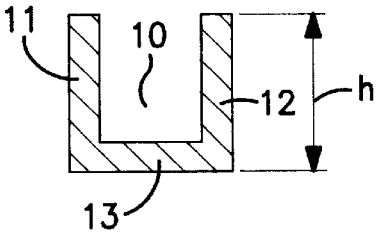
FIG. 4E is a view in transverse cross section on the line III—III of FIG. 4A.

The beam structure 10 shown in FIG. 4A rests on a simple support 14 at one of its ends, on a simple support 16 at the other end and on a simple support 15 in its central portion, and comprises a first prismatic body 11 of rectangular cross section for example, a third prismatic body 12, for example of rectangular cross section, facing the first body 11 and parallel to the latter as shown in FIGS. 4C, 4D, 4E. The first and third bodies have a length defining the length of the beam structure 10 and a height h preferably constant over the length of the beam structure 10 and defining the height of this latter. The beam structure 10 comprises a second body 13 which connects the first 11 and third 12 bodies over the length of these latter according to a position variable in height relative to the first or third bodies as shown in FIGS. 4A and FIGS. 4C, 4D, 4E, as a function of the envelope curve of the bending moments shown in FIG. 4B, such that the second body 13 will be positioned in the compression region of a transverse section of the beam structure 10. The first, second and third bodies form a monoblock beam structure 10 and are constituted of reinforced concrete, or of any other known cast material, whose reinforcements (not shown) will be preferably distributed throughout the concrete in any known manner.

The envelope curve of the bending moments shown in FIG. 4B is elaborated from constant and variable bending forces applicable to the beam structure on the three simple supports, according to any known means and method of computation. This curve takes into account the permanent loads, particularly the weight of the structure itself of the beam and the variable added loads, for example a movable load moving along the length of the beam structure. The curve of the bending moments shown in FIG. 4B is given by way of example, and for this reason the ordinates and the values of the moments has deliberately not been quantified.

The envelope curve of the moments shown in FIG. 4B shows positive moments of maximum absolute value spanwise, and maximum negative moments in absolute value in the central support region 15. For each transverse section of the beam, parallel to the axis of the ordinates in FIG. 4B, the envelope curve of the moments indicates the applicable algebraic bending moments, which are a maximum on the curve C1 and minimum on the curve C2.

Considering the span between the supports 14 and 15, it will be seen that the moments are always positive in one portion of the beam structure near the support 14; the second body 13 will then be disposed at the upper end of the first 11 and third 12 bodies, as shown in FIG. 4C; it is to be noted that the bending moments being digressive to cancel the simple support 14, the second body 13 could be disposed at any point along the height of the first and third bodies, and will be disposed at the upper end of these latter so as to simplify the production and reduce costs. It will also be seen that the moments are always negative in a portion of the beam structure adjacent the support 15; the second body 13 will then be disposed at the lower end of the first 11 and third 12 bodies as shown in FIG. 4E. Between the two above portions of the beam structure, subjected always to positive moments or always to negative moments, there will be seen an intermediate portion for which the moments will be positive or negative as a function of the position of the variable added loads on the beam structure; the second body 13 will then adopt a variable position between the high and low extreme positions defined above, as follows: the second body 13 will be disposed at the middle of the height of the first and third bodies, as shown in FIG. 4D, for the transverse cross section in which the maximum and minimum algebraic moments will be on the average low or zero, one skilled in the art being thus assured that the dimensions of this transverse section are sufficient to resist the maximum and minimum bending moments given by the envelope curve of the moments for the corresponding abscissa; the second body 13 will ensure a longitudinal continuity between the upper and lower end positions by passing through the intermediate position defined above, such that each transverse section will be adapted to resist the maximum and minimum bending moments defined by the envelope curve of the moments at the corresponding abscissa. It is to be noted that the second body 13 can be elongated axially at the upper or lower end of the first 11 and third 12 bodies in the intermediate portion for which the moments can be positive or negative, and that conversely, the variation in position of the second body can begin whilst the bending moments are all positive or are all negative, any transverse section of the beam structure being always adapted to resist the maximum and minimum algebraic moments given by the envelope curve of the moments at the corresponding abscissa. The second body 12 will adopt, in its portion of variable position, preferably a slope of the order of 20% without exceeding 30%; if a slope higher than 30% is seen to be necessary as a function of the envelope curve of the moments, one skilled in the art will preferably choose to increase the height h of the first and third bodies for example. FIGS. 4C, 4D, 4E show that the first 11, second 13, and third 12 bodies define a transverse cross section of the beam structure 10, varying from an inverted U shape to a U shape across the span comprised between supports 14 and 15, passing through an H shape.

In the span between the supports 15 and 16 of the example of FIG. 4A, the position of the second body 13 on the beam structure is defined by symmetry relative to a transverse plane passing through the continuous support 15.

The height h and the thickness of the first and third bodies, preferably constant in the example of FIG. 4A, will be defined in any known manner, in particular as a function of the permissible camber. The width and the thickness of the second body 13 will be defined in any known manner, in particular as a function of the moments of inertia of the first and third bodies so as to ensure the resistance of the beam structure to the applicable bending moments. It will be noted that the first and third bodies have been shown parallel defining a constant width of the second body 12 over the length of the structure of the beam, but could alternatively be non-parallel and form between them an angle of small opening. This angle will preferably be a function of a general width to be given to the beam structure, dependent on the architecture of the project to be constructed and which can impose different widths on the two ends of the beam structure.

It is to be noted that the second body, which has been shown as a thin shell of reinforced concrete of constant thickness all along the structure of the beam, can instead be a shell of variable thickness as a function of the shear force curve (not shown) applicable to the beam structure 10. Thus, toward the supports, the shear force is maximum and the thickness of the second body could be greater than in the span where the shear force is lower. The variation of thickness along the length of the beam structure could preferably be continuous.

The beam structure according to the invention shown in FIG. 4A comprises a first, a second and a third body. Another example of embodiment could consist of a beam structure comprising only a first and second body connected laterally to the first body, as defined above. The second body could be or not extended symmetrically laterally on opposite sides of the first body.

Figure 5:
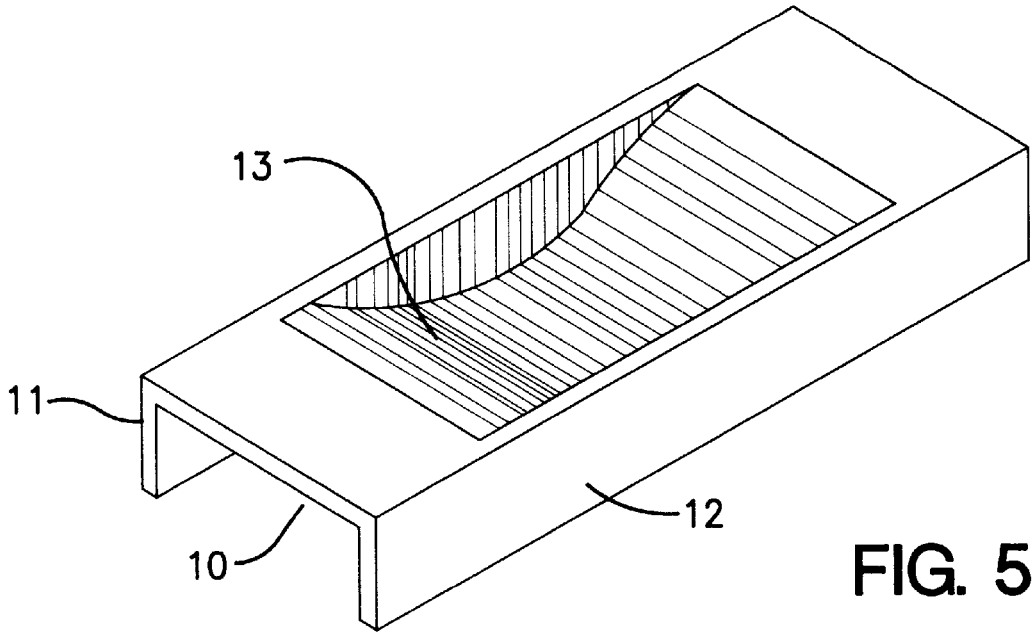
FIG. 5 shows an example of FIG. 4A in perspective.

FIG. 5 shows in perspective the structure of the beam according to the invention shown in FIG. 4A, the supports having not been shown.

Figure 6:
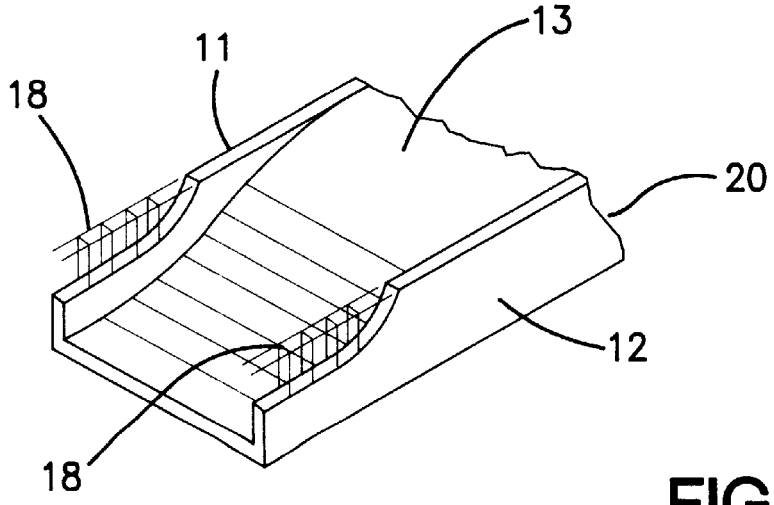
FIG. 6 shows a partial perspective view of a second embodiment of a beam structure according to the invention.
Figure 7:
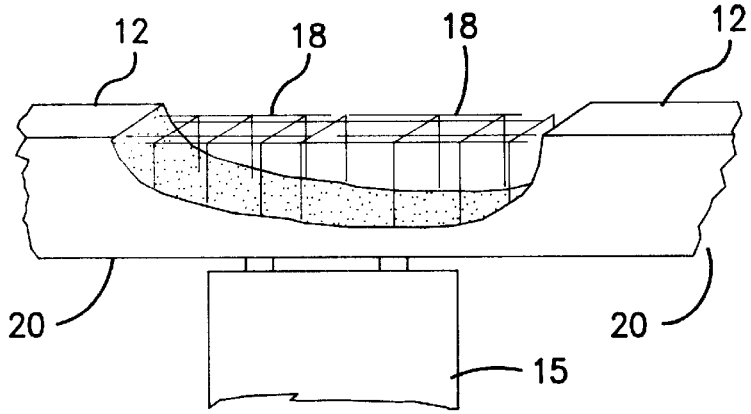
FIG. 7 shows a fragmentary perspective view of a longitudinal assembly of two beam structures according to FIG. 6.

It will be noted that the beam structure according to the invention is preferably present in the form of a modular structure and can comprise tensioned steel at the end of a module so as to ensure the continuity of the tensioned portion of the section over a continuous support with another module, as shown for example in FIGS. 6 and 7. In FIGS. 6 and 7, the elements fulfill similar functions to those of the elements of FIGS. 4A, 4C, 4D, 4E and are given the same reference numerals. In FIG. 6, the first 11 and third 12 bodies of a module 20 comprise tensioned steel 18 for a continuity of the module 20 with another module 20, as shown in FIG. 7, by casting concrete to take up the bending moments in the stretched portion of the section of continuous support 15, the bending moments in the compressed portion of transverse section at support 15 being taken up by the second body (not shown) disposed at the lower end of the first and third bodies on the modules 20.

Figure 8:
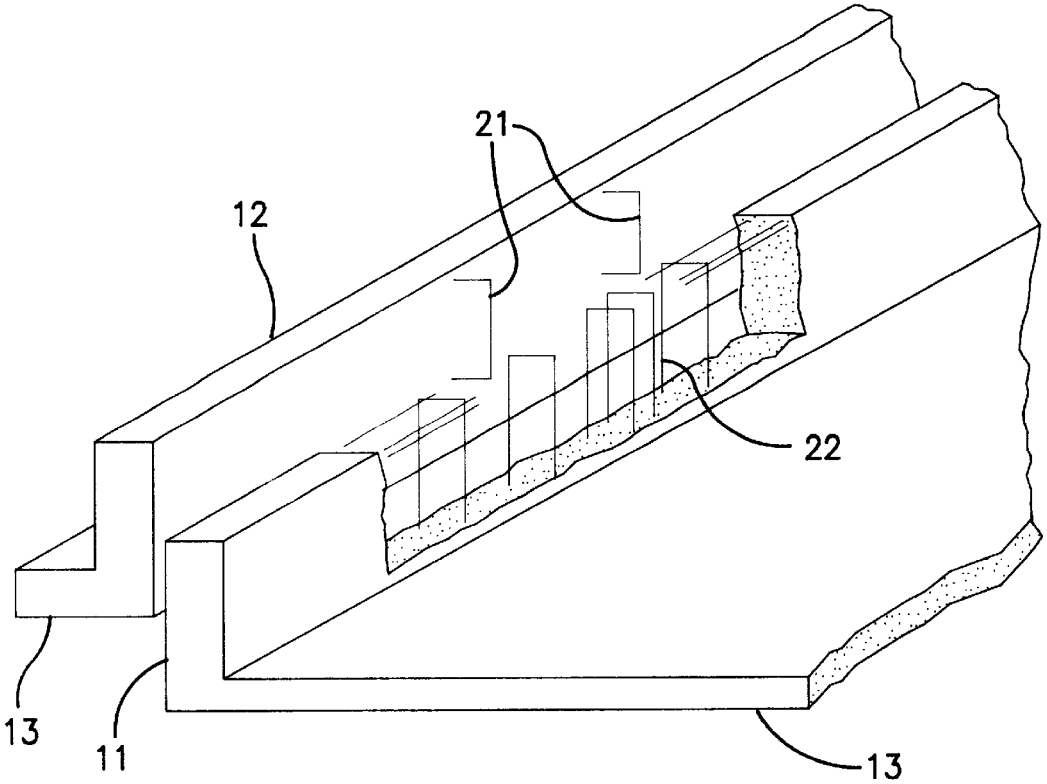
FIG. 8 shows a fragmentary perspective view of a first mode of lateral assembly of two beam structures according to the invention.

FIG. 8 shows two beam structures adapted to be connected laterally so as to permit distribution of the forces due particularly to imposed loads, and thereby ensuring the construction of a bridge platform with parallel beams for example. The beam structures forming the platform are disposed parallel, and two adjacent beam structures are preferably connected by casting concrete, after the positioning, by means of lateral frames 21 and reservations 22 provided for this purpose in the two bodies 11 and 12 respectively adjacent, as shown in FIG. 8, on which the longitudinal steel members are not shown. The points of lateral connection between two structures of adjacent beams will preferably be regularly spaced along the length of the latter. Each beam structure comprising a horizontal or vertical structure as described above could also be connected laterally to two adjacent beam structures as the case may be.

Figure 9A:
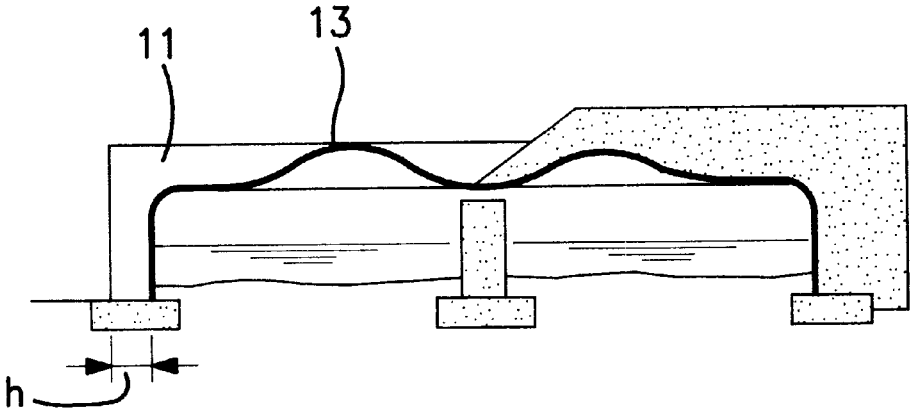
FIG. 9A shows in longitudinal cross section a third embodiment of a beam structure according to the invention.
Figure 9B:
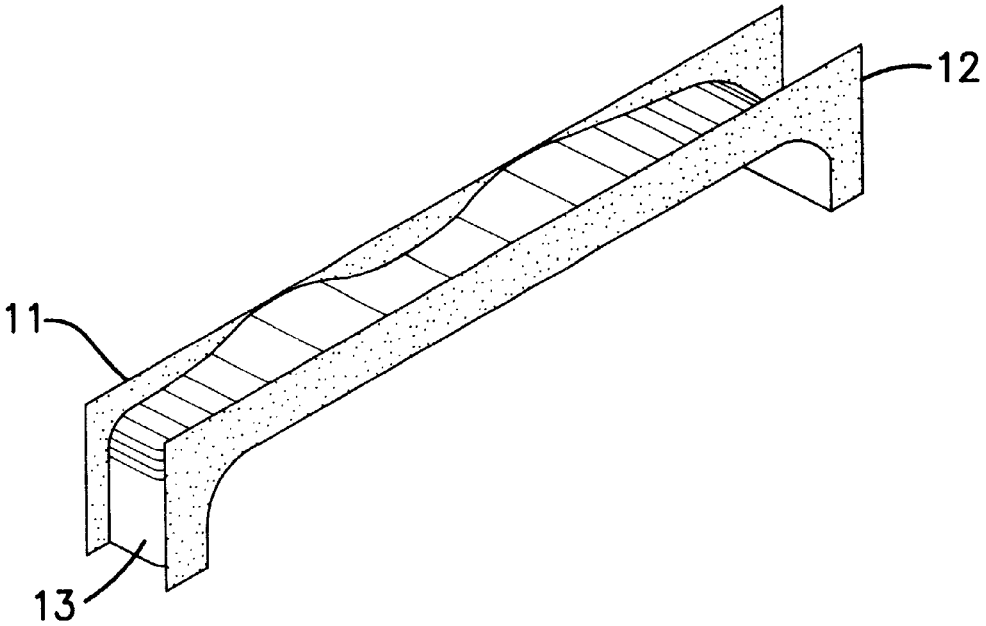
FIG. 9B is a perspective view of the beam structure of FIG. 9A.

FIGS. 9A and 9B show a beam structure according to the invention forming an arched bridge. The structure comprises a first 11, a third 12, and a second 13 body, the latter defining in a monoblock fashion the platform and the abutments of the arched bridge. The first 11 and third 12 bodies comprise respectively, perpendicular to a longitudinal axis of the first body, a first extension at one end and a second extension at the other end, the second 13 body being connected laterally to the first and second extensions over the length of these latter, according to a variable position over the height h of the first and second extensions, as a function of the curve of bending moments (not shown), such that the second body will be positioned in the compression region of a transverse section of the first and second extensions. It will be noted that the second body 13 has as a platform a shape adapted for a central support on a pillar according to the curve of bending moments (not shown). It will be noted that on FIGS. 9A and 9B, the second body 13 for the abutments is shown in a constant position relative to the first and third bodies because of the low height of the abutments. The second body can preferably have a variable position on the abutments as a function of the curve of the bending moments for these latter, as will be explained latter.

It will be noted that the beam structure shown in FIGS. 9A and 9B need only comprise one extension perpendicular to a single one of its ends as the case may be, the other end then resting on any other type of support.

Figure 10A:
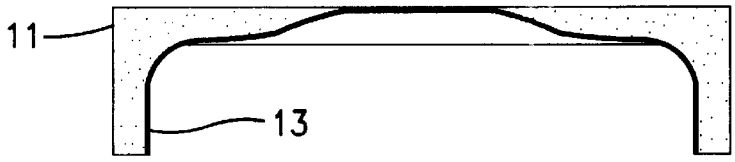
FIG. 10A shows in longitudinal cross section a fourth embodiment of a beam structure according to the invention.
Figure 10B:
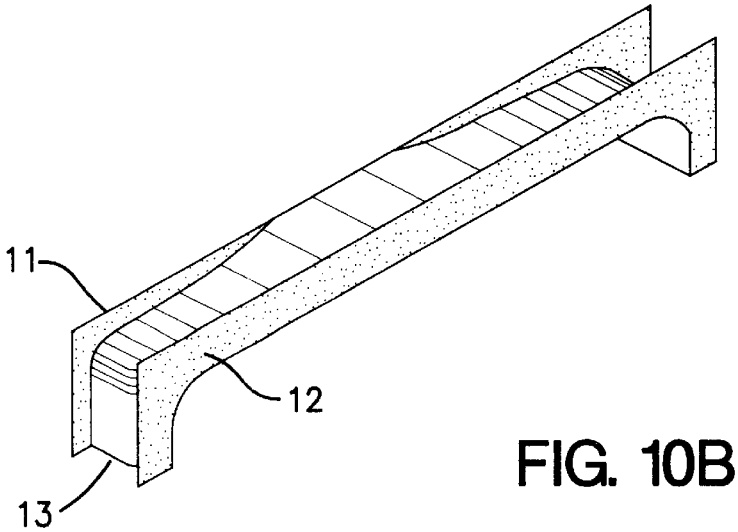
FIG. 10B shows in perspective the beam structure of FIG. 10A.

FIGS. 10A and 10B show a beam structure according to the invention forming an arched bridge, similar to that shown in FIGS. 9A and 9B, but whose second body 13 has the shape of a platform avoiding the use of a central support.

Figure 11:
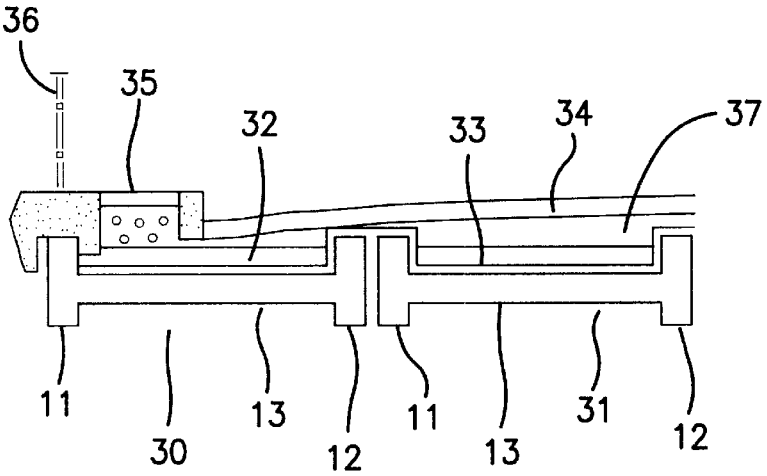
FIG. 11 shows in partial transverse cross section a first example of an embodiment of a horizontal structure according to the invention forming a bridge platform.

FIG. 11 shows a horizontal structure forming a bridge platform comprising a plurality of beam structures 30, 31 according to the invention disposed longitudinally in parallel. The beam structures support for example in a known manner as shown in FIG. 11, a sealing layer 33 following particularly the profile of the second body 13, permitting forming low points on the sealing layer and thus gathering drainage water in the region of the continuous supports, a layer of insulating material 32 which is preferably light and little compressible, for example of the polystyrene type or the like, whose thickness will preferably be constant, and a drainage layer 37 of which the thickness will preferably be variable to form a substantially flat layer adapted to receive a roadway 34 of constant thickness. A sidewalk 35 supporting a guardrail has also been shown. Two adjacent beam structures composing the platform can preferably be laterally connected as explained above.

Figure 12A:
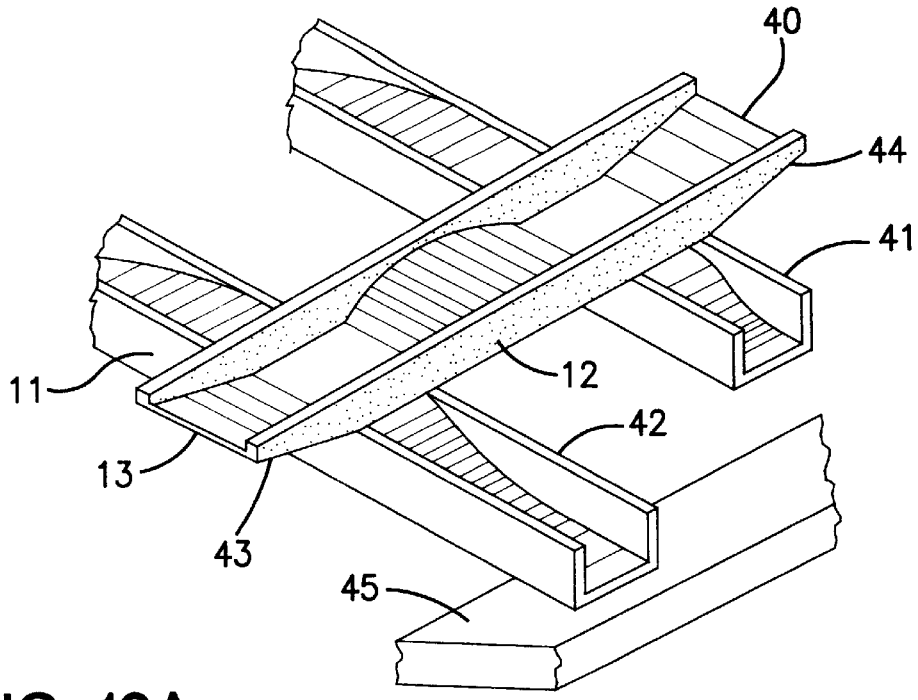
FIG. 12A shows in perspective and in exploded view an example of the manner of assembly of beam structures according to the invention.
Figure 12B:
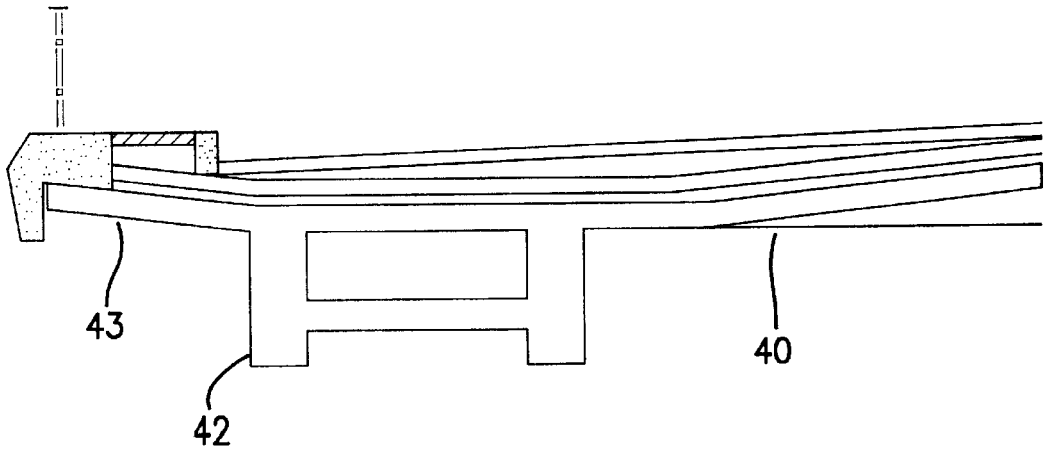
FIG. 12B shows in partial cross section a second example of an embodiment of a horizontal structure according to the invention forming a bridge construction, obtained by the mode of assembly shown in FIG. 12A.

FIGS. 12A and 12B show an example of an embodiment of assembling beam structures according to the invention, permitting the production of a horizontal structure according to the invention forming a bridge construction. The platform comprises a plurality of beam structures 40 according to the invention disposed parallel and transversely to the longitudinal axis of the platform, which is supported by two beams 41 and 42 according to the invention disposed in a longitudinal manner, as shown in FIG. 12A. It is to be noted that only one beam structure comprising the platform has been shown. The beam structure 42 has been shown resting on an abutment 45. Corbelles 43 and 44 formed by the ends of the beam structure 40 are preferably raised as shown in FIG. 12A. This type of construction is more particularly adapted for large spans. In FIG. 12B, there is shown the different layers forming a roadway in a manner similar to FIG. 11.

Figure 1A:
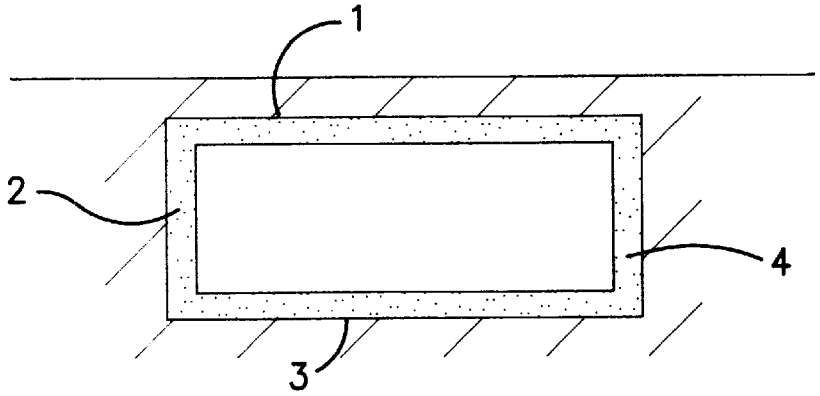
FIG. 1A PRIOR ART
FIG. 1A shows a transverse cross-sectional view of a construction of the prior art of the square bridge type.
Figure 1B:
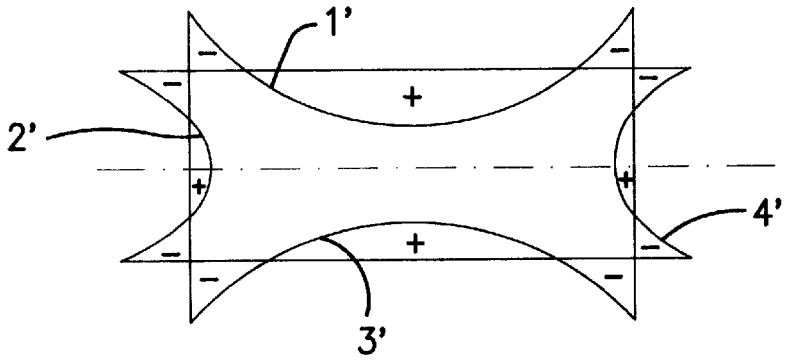
FIG. 1B PRIOR ART
FIG. 1B shows curves representative of the bending moments of the construction of FIG. 1A.
Figure 1C:
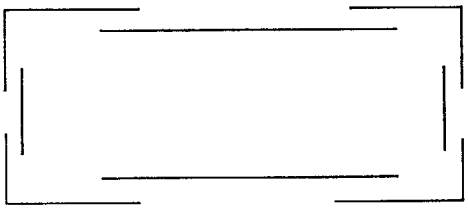
FIG. 1C PRIOR ART
FIG. 1C shows schematically a transverse cross section of the principal metallic reinforcement of the construction of FIG. 1A.
Figure 2A:
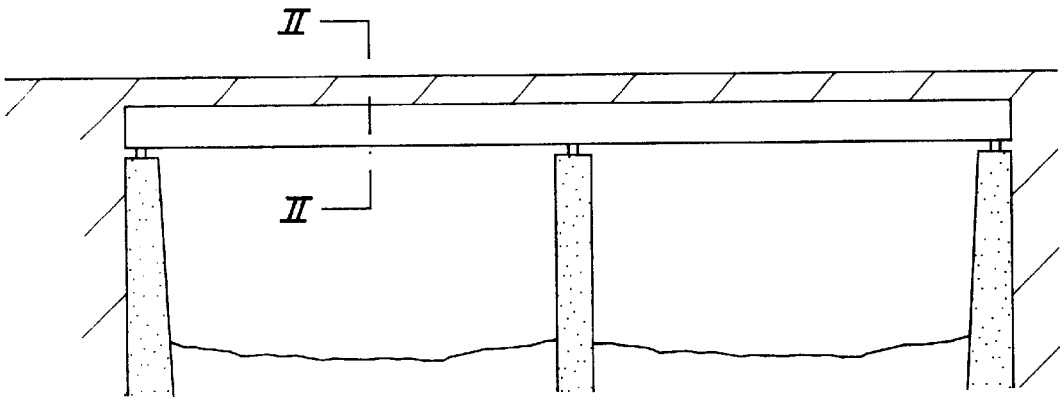
FIG. 2A PRIOR ART
FIG. 2A is a longitudinal cross-sectional view of a construction of the prior art of the type of a bridge with multiple beams interconnected by a rough wall.
Figure 2B:
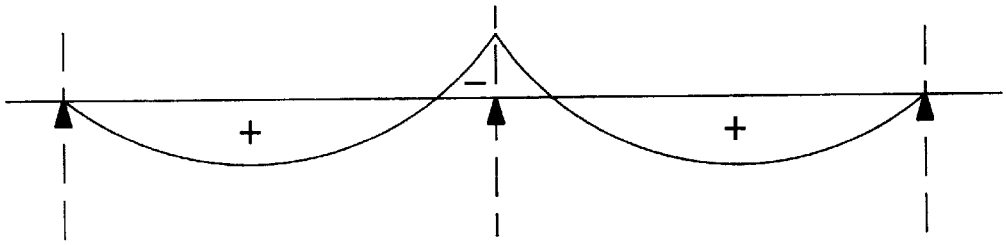
FIG. 2B PRIOR ART
FIG. 2B shows partially the curves representative of the bending moments of the construction of FIG. 2A.
Figure 2C:
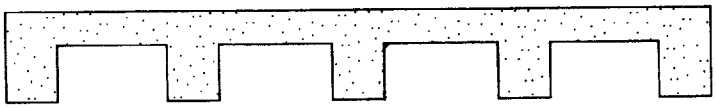
FIG. 2C PRIOR ART
FIG. 2C is a view in cross section on the line II—II of the construction of FIG. 2A.
Figure 3A:
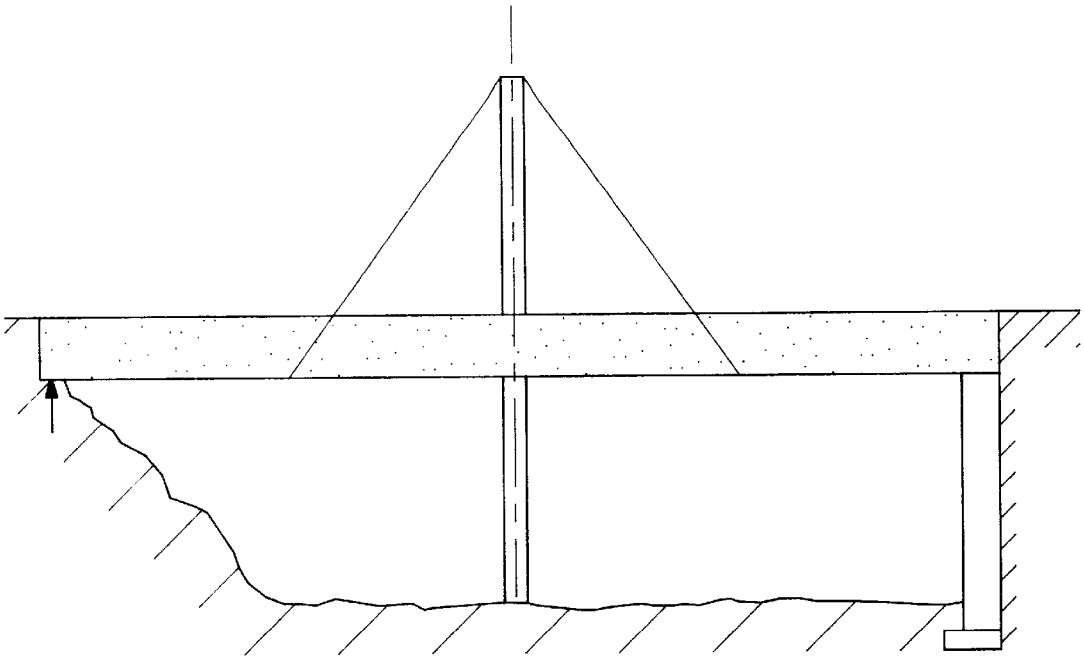
FIG. 3A PRIOR ART
FIG. 3A shows a longitudinal cross-sectional view of a construction of the prior art of the bridge type with masts and stays.
Figure 3B:
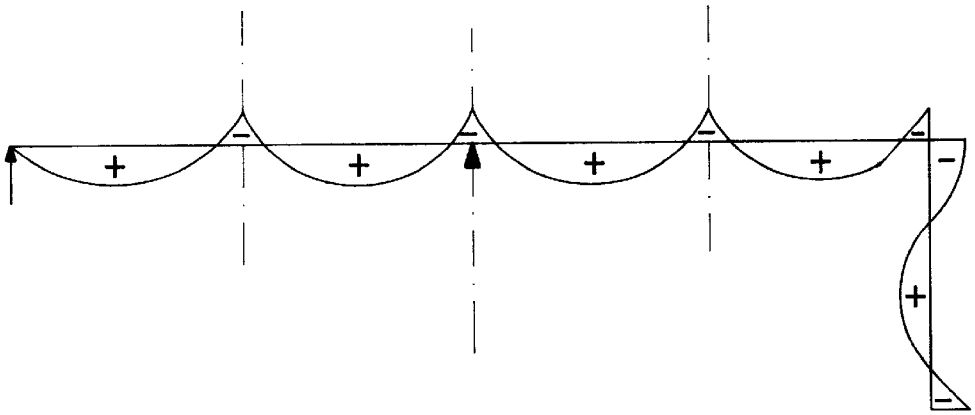
FIG. 3B PRIOR ART
FIG. 3B shows curves representative of the bending moments of the construction of FIG. 3A.
Figure 13A:
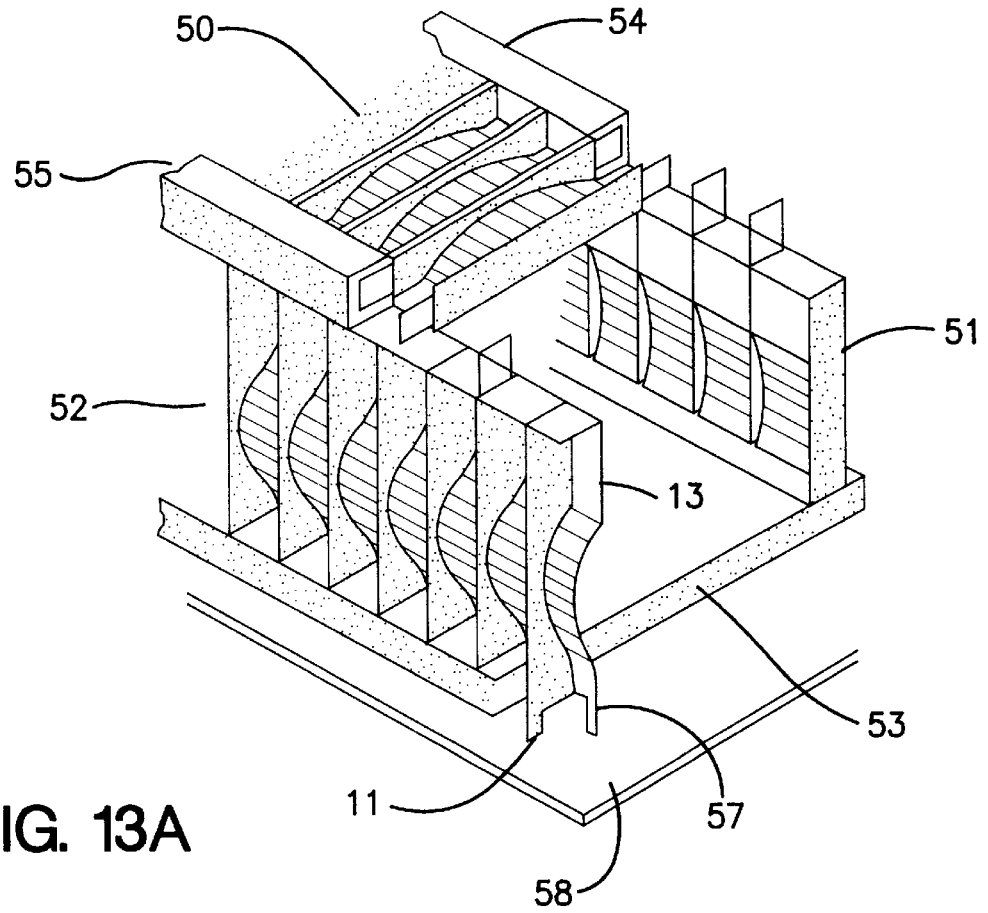
FIG. 13A is a fragmentary perspective view of an embodiment of a structure according to the invention forming a bridge construction.
Figure 13B:
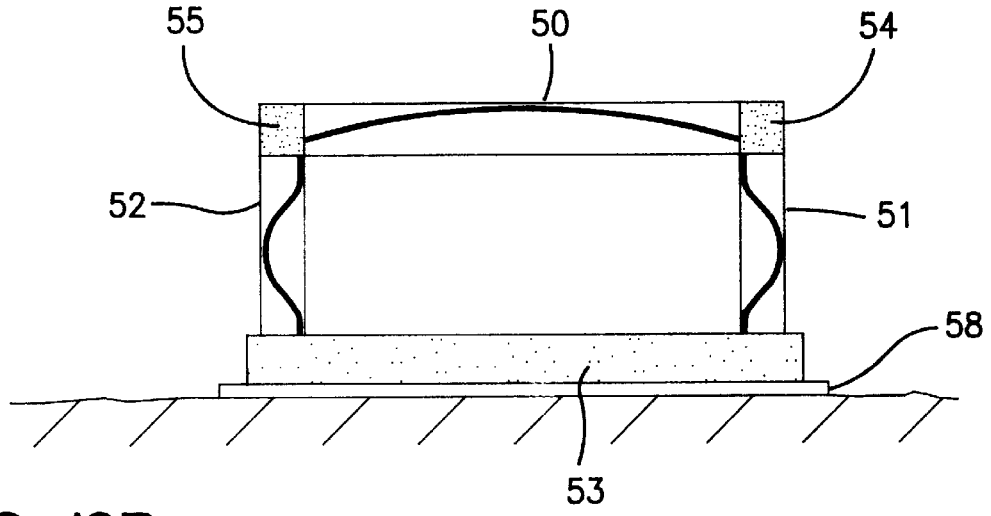
FIG. 13B shows in transverse cross section the example of FIG. 13A.

FIGS. 13A and 13B show an example of embodiment of a structure according to the invention forming a square bridge. A horizontal structure forming the platform 50 comprises a plurality of beam structures according to the invention disposed parallel and transversely to the longitudinal axis of the bridge, whose ends rest by means of encased supports 54, 55 on vertical structures according to the invention forming abutments 51 and 52. The abutments 51 and 52 are each formed by a plurality of beam structures according to the invention disposed parallel and vertically, as shown in FIG. 13A. The abutments 51 and 52 are each formed by a plurality of beam structures according to the invention disposed parallel and vertically, as shown in FIG. 13A. The abutments 51 and 52 rest by means of encased supports on a slab 53, which itself rests on supporting concrete 58. The curves showing the bending moments applicable to the platform and to the square bridge abutments shown in FIG. 13A are shown in FIG. 1B. It is to be noted that this type of curve is applicable to permanent loads or imposed loads which are often preponderant. The beam structures according to the invention forming the abutments 51 and 52 and the platform 50 are determined as a function of the curves of the respective bending moments as explained above. Two adjacent beam structures comprising the platform or the abutments can preferably be connected laterally as explained above. It will be noted that, given the lightening of the structures due to optimization of the cross section of the concrete acting in compression, a platform 50 or an abutment 51, 52 can preferably be prefabricated of a single piece, as the case may be, thereby forming preferably a monoblock construction module.

As needed, particularly as a function of the available emplacement and for aesthetic reasons, the beam structure according to the invention forming the front end of the construction for the abutments or for the platform, for example the beam structure 57 forming the front end of the abutment 52 in FIG. 13A, can preferably comprise only a first 11 body and a second 13 body. In this case, the second body 13 forming the end of the abutment 52 could be produced with a variable width, which permits adapting the end of the construction as a function of the architectural dimensions imposed by the site. As the case may be, a lateral connection between the beam structure 57 and the adjacent beam structure could preferably be provided to ensure stability during pouring.

Figure 13C:
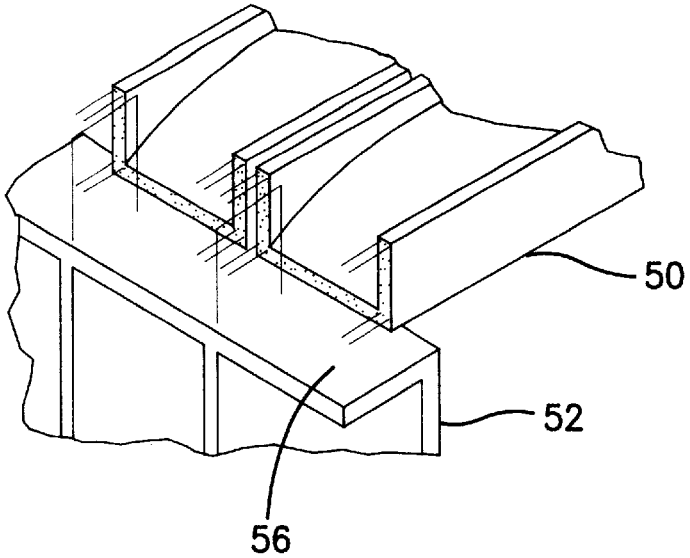
FIG. 13C shows in perspective and in an enlarged view a detail of the example of FIG. 13A.

FIG. 13C shows the detail of the steel work before casting at one end of the beam structures forming the platform and at the upper end of the beam structures forming an abutment, so as to ensure the provision of an encased support resisting the bending moments. It will be noted that the upper end of the beam structures forming the abutments preferably comprises a platform 56 so as to facilitate casting of the supports.

Figure 14:
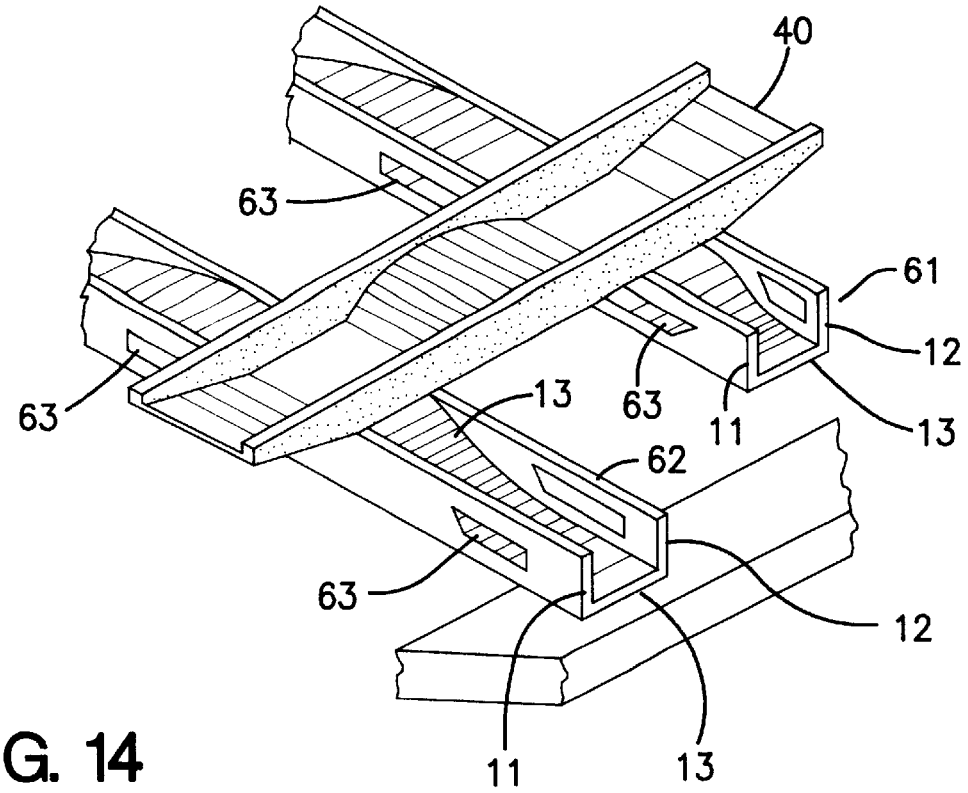
FIG. 14 shows in fragmentary perspective a fifth example of an embodiment of a beam structure according to the invention.

FIG. 14 shows a mode of assembly similar to that of FIG. 12A but which is different from this latter by longitudinal beam structures 61 and 62 for supporting the platform, whose first and second bodies 11 and 12 comprise openings 63. The openings 63 are preferably disposed in tensioned regions of the first and third bodies of the beam structure, for example as shown in FIG. 14, and thereby permit desirably lightening all the structure of the beam according to the invention without changing its own strength.

Figure 15A:
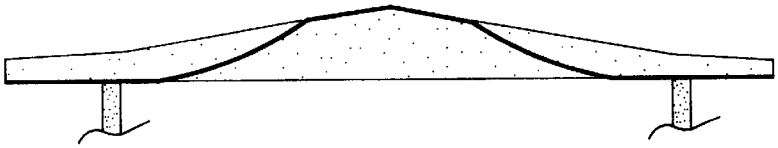
FIG. 15A shows a side view of a sixth example of an embodiment of a beam structure according to the invention.
Figure 15B:
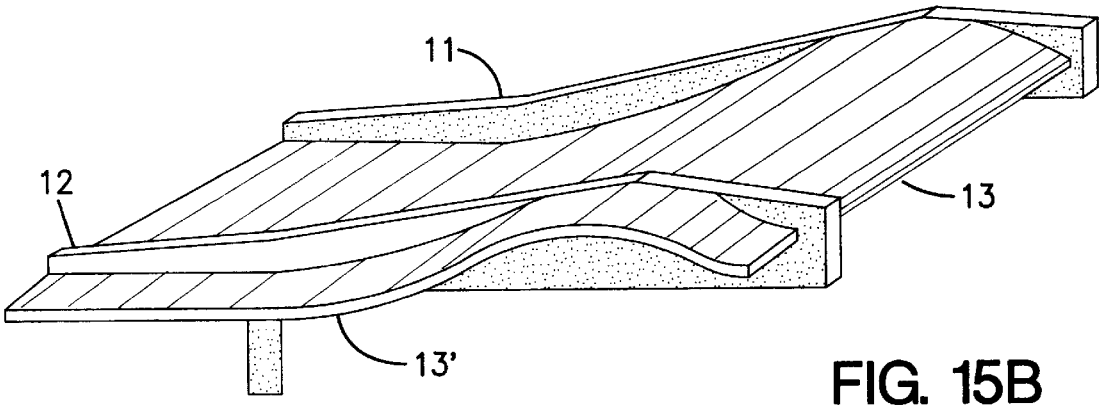
FIG. 15B shows in fragmentary perspective view the beam structure of FIG. 15A.

FIGS. 15A and 15B, show an example of beam structure in which the first and third bodies 11 and 12 have a variable transverse cross section permitting the second body 13 to have greater variations in height position to obtain higher moments of inertia. This type of beam structure is more particularly adapted for or at wide spans. It will be noted that the second body can preferably extend outside the third body 12, as shown in FIG. 15B, as needed, for the available emplacement, for aesthetic reasons, or for reasons of strength, particularly to increase the section working in compression without modifying the spacing of the first and third bodies.

Figure 16A:
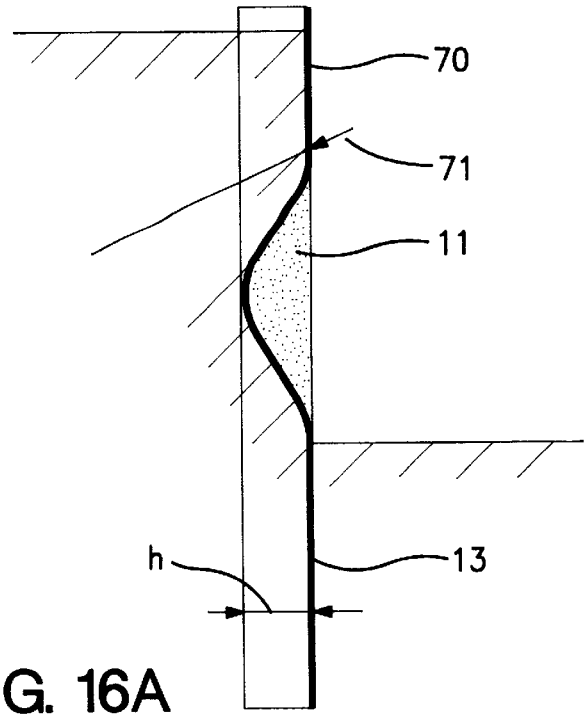
FIG. 16A shows in longitudinal cross section an example of an embodiment of a vertical structure according to the invention forming a support wall.
Figure 16B:
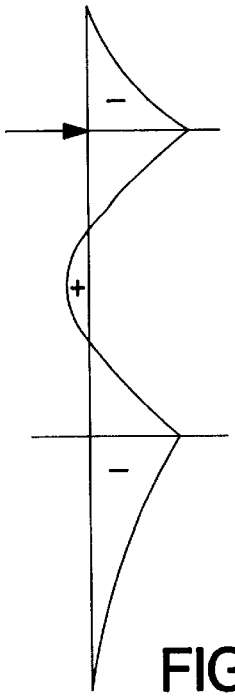
FIG. 16B shows a curve representative of the bending moments of the structure of FIG. 16A.

FIG. 16A shows a supporting construction comprising one or several beam structures according to the invention disposed parallel and vertically. The beam structures 70 forming the supporting wall is encased in the ground at one end, and can preferably comprise a support at its upper portion in the form of a tie rod 71 anchored in the embankment and fixed to the beam structure, as shown in FIG. 16A. The beam structure 70 according to the invention preferably comprises a first 11, a second 13 and a third body (not shown), the second body 13 having a variable position along the height h as a function of the applicable bending moments curve, particularly shown in FIG. 16B. The curve of bending moments shown in FIG. 16B shows regions of negative moments at the supports, which is to say at the tie rods 71 and at the burial in the ground, and the zone of positive moments between supports due principally to the pressure of the embankment. The second body 13 will vary in position along the height h such that it will be positioned in the zones comprised within a beam structure, as described above. It is to be noted that according to the height of the supporting wall, a plurality of anchoring tie beams can preferably be disposed along the beam structures comprising it, which determines a different curve of bending moments, taking account of each tie rod as a simple support, and because of this a position of the second body adapted as a function of this curve. It will be noted that, as for the abutments of the construction shown in FIG. 13A, the support wall according to the invention could preferably be prefabricated from a single piece as the case may be.

Figure 17:
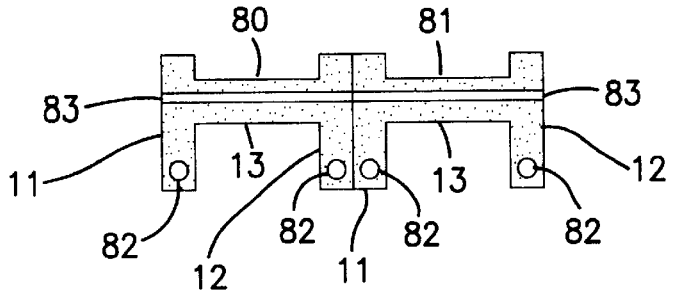
FIG. 17 shows a transverse cross section of a seventh embodiment of a beam structure according to the invention.

FIG. 17 shows a beam structure of prestressed or post-stressed concrete. For this purpose, cables (not shown) can preferably be disposed longitudinally of the interior of recesses 82 provided in the first 11 and third 12 body of a beam structure 80, 81 according to the invention, as shown in FIG. 17 for example. The beam structure according to the invention could preferably comprise transverse recesses 83 in the second body 13, provided or not with sheaths, adapted to ensure the passage of tensioning cables (not shown) transversely through a plurality of parallel beam structures 80, 81 forming a bridge construction, as shown partially in FIG. 17. It is to be noted that the longitudinal tensioning cables can be disposed alternately in longitudinal cutouts formed for this purpose in the external portion of the first and third bodies for example, this technique being called external poststress.

Figure 18:
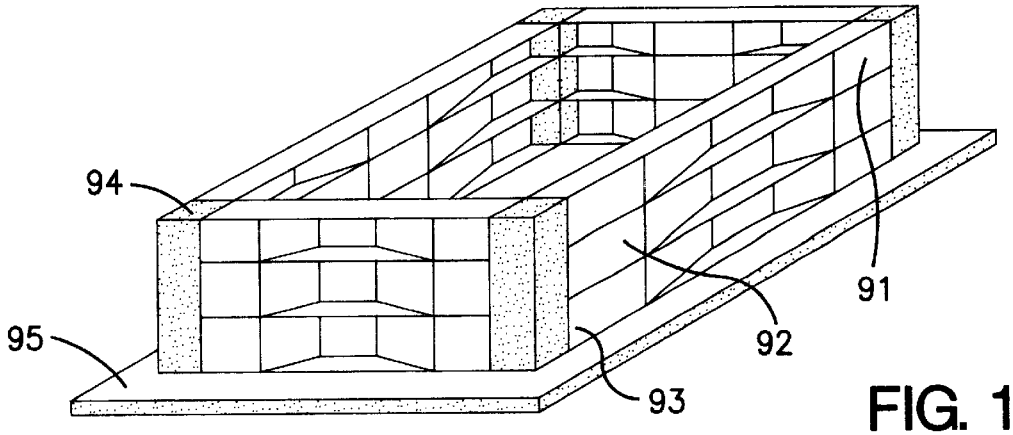
FIG. 18 shows in perspective an example of an embodiment of a vertical structure according to the invention forming a reservoir.

The vertical structure forming a reservoir or a balancing shaft according to the invention shown in FIG. 18 comprises beam structures 91, 92, 93 according to the invention disposed horizontal and stacked on each other to form the four walls of a reservoir, as shown in FIG. 18. Four corner posts 94 at the four corners of the vertical structure ensure the interconnection of the walls. The profile of the second body of each of the beam structures 91, 92, 93 is determined as a function of the respective curves of bending moments, as explained above, which are established for example in the case of a reservoir, principally as a function of the pressure exerted by the contents on the walls of the reservoir. A general foundation 95 ensures sealing of the construction at its bottom, the sealing of the walls being preferably ensured according to any known means between the structures of stacked beams, or by any suitable sealing cladding disposed on the internal surface of the walls.

Figure 19A:
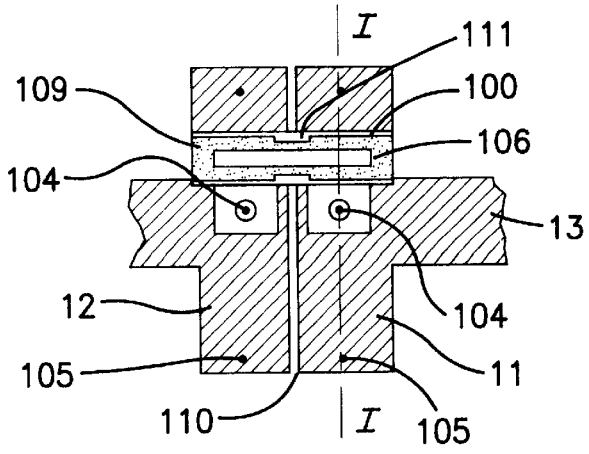
FIG. 19A shows in fragmentary transverse cross section a second embodiment of a lateral assembly of two beam structures according to the invention.

The two beam structures according to the invention shown in FIG. 19A are assembled by means of their third 12 body and first 11 body respectively. To this end, and for assembly, as shown in FIG. 19A, two tubular elements 100, preferably metallic, are secured transversely in the third 12 and first 11 bodies for example of the beam structures to be assembled, respectively. The two tubular elements 100 will be substantially aligned when the beam structures are in the assembly position, so as to permit the emplacement in an axial manner, within the tubular structures 100, of a metal bar 106 adapted to resist transverse shear forces and of a length slightly less than the thickness of the first and third bodies and of the joint 100 between these latter. The bar 106 will preferably be maintained within the elements 100 by means of the injection of a bonding agent 109, constituted of mortar for example, so as to permit by means of the transverse section thus obtained, comprised by the bar 106 and the bonding agent 109, the distribution over the two beam structures thus assembled, particularly of the variable applied forces applied to one or the other of the beam structures. The bonding agent 109, thus rigidly connecting the bar 106, the first body 11 and the third body 12, will preferably be injected along the total length defined by the thickness of the bodies 11 and 12, and so that it does not flow into the joint 110 between the first 11 and third 12 bodies, there will be emplaced before injection a sealing element 111 within and between the two tubular elements 100.

Figure 19B:
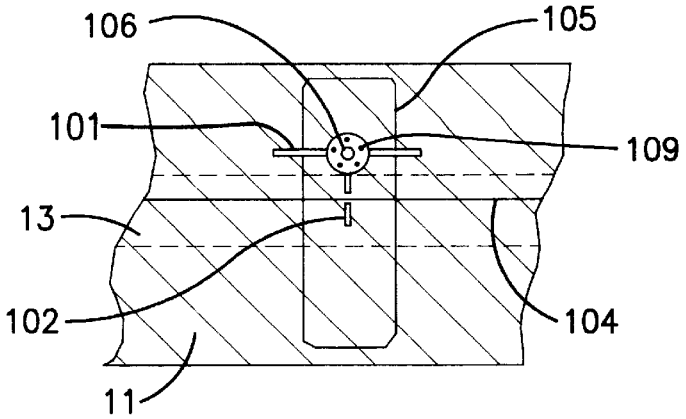
FIG. 19B is a view in fragmentary longitudinal cross section on the line I—I of FIG. 19A.
Figure 19C:
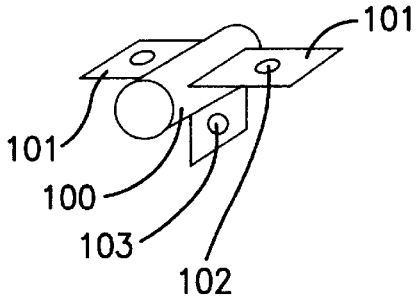
FIG. 19C is a perspective view of a first particular element used in the manner of assembly shown in FIG. 19A.
Figure 19D:
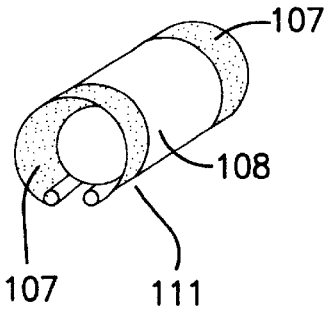
FIG. 19D shows in perspective a second particular element used in the manner of assembly shown in FIG. 19A.
Figure 19E:
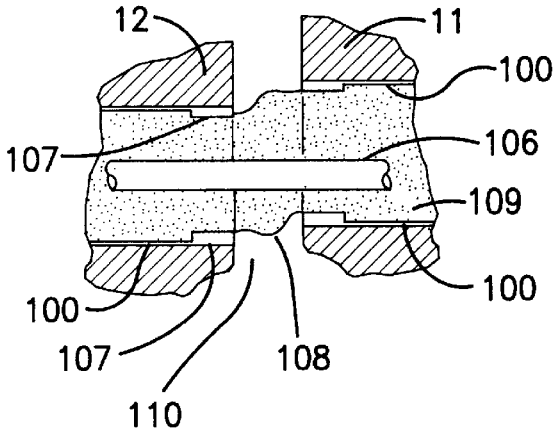
FIG. 19E shows a transverse cross section of an enlarged detail of FIG. 19A.

FIG. 19D shows an example of an embodiment of the sealing element 111 which comprises a flexible tubular central portion 108, for example a rubber tube, so as to absorb any error of alignment of the two tubular elements 100, as shown in detail in FIG. 19E, and an elastic ring 107 fixed at each axial extremity of the central tubular portion 108, so as to ensure the maintenance in contact and in sealing relationship of the element 111 with each of the two tubular elements 100.

FIG. 19C shows an example of embodiment of a tubular element 100 which comprises a metallic tube of a length substantially equal to the thickness of the first or third bodies in which it is inserted, on which are secured, for example by welding, two horizontal plates 101 and a vertical plate 102, each plate 101 and 102 comprising a hole 103 adapted to permit the passage of metallic reinforcements, vertical 105 and horizontal 104, respectively, as shown in FIG. 19B. The object of the reinforcements 104 and 105 and the plates 101 and 102 is to permit better distribution of the forces in the lateral connection regions of the structures of assembled beams.

It will be noted that the lateral connection point as described above at the support of FIGS. 19A to 19E could preferably be multiplied along the length of two adjacent beam structures so as to ensure distribution of the forces along the length of these latter. Moreover, each beam structure comprising a horizontal or vertical structure could thus be connected in a lateral manner to two adjacent beam structures, as the case may be.

It will be noted that the beam structure according to the invention can find numerous applications, particularly according to the examples of embodiment and combinations of assembly described above, and according to other combinations that those skilled in the art could easily make, particularly in construction of horizontal structures and the construction of supporting walls, or of vertical partition structures for example.

I claim:

1. Beam structure adapted to be subjected at least to a bending force determining along said beam structure an envelope curve of the bending moments which comprises at least one first part in which the bending moments are of the same first sign, at least one second part in which the bending moments are of a same second sign opposite said first sign, and at least one third part in which the bending moments can be of said first sign or said second sign or zero, said beam structure comprising particularly concrete, at least one first (11) body whose height and length define respectively the height and length of said beam structure, characterized in that said beam structure comprises a second (13) body connected laterally to the first body along the length of said first body, said second body being disposed at an upper end of the height of said first body in the first part of said curve envelope of the bending moments, said second body being disposed at a lower end of the height of said first body in the second part of said curve envelope of the bending moments, and in that said second body is continuous longitudinally and is disposed at a variable position along the height of said first body, from said upper end to said lower end in the third part of said curve envelope of the bending moments.

2. Beam structure according to claim 1, characterized in that said second body (13) is disposed at the middle of the height of said first (11) body in the transverse section in which the maximum and minimum algebraic bending moments of the third part of said curve envelope of the bending moments are on the average low or zero.

3. Beam structure according to claim 1 characterized in that said second body (13) has, in the third part of said curve envelope of the bending moments, a slope of the order of 20%.

4. Beam structure according to claim 1, characterized in that said at least first body (11) comprises, perpendicular to a longitudinal axis of said first body, at least one first extension at one end, and in that said second (13) body is connected laterally to said first extension over the length of this latter, according to a position variable along the height (h) of said first extension, as a function of said curve envelope of the bending moments, such that said second body will be positioned in the zone comprised by a transverse section of said first extension.

5. Beam structure according to claim 4, characterized in that said at least first body (11) comprises in a manner perpendicular to a longitudinal axis of said first body (11), at least one second extension at the other end, and in that said second (13) body is connected laterally to said second extension over the length of the latter, according to a position variable along a height (h) of said second extension, as a function of said curve of bending moments, such that said second body will be positioned in the region comprised by a transverse section of said second extension.

6. Beam structure according to claim 1, further comprising a third body (12) arranged parallel to said first body, said third body being connected to said second body (13).

7. Beam structure according to claim 6, characterized in that said first (11), second (13), and third (12) bodies define a transverse cross section of said beam structure, varying from the shape of an inverted U to a U shape over at least a portion of the length of said beam structure, passing through an H shape.

8. Beam structure according to claim 6, wherein said second body (13) extends outside at least one of said first body (11) and said third body (12).

9. Beam structure according to claim 6, characterized in that said first (11) and third (12) bodies are parallel.

10. Beam structure according to claim 1, wherein at least one of said first body (11) and said third body (12) comprises at least one opening (63).

11. Beam structure according to claim 1, characterized in that said second (13) body comprises thin shell of reinforced concrete of variable thickness.

12. Construction module characterized in that it comprises a plurality of beam structures according to claim 1, said beam structures being positioned parallel and constituting a single member.

13. Horizontal structure, characterized in that it comprises at least one plurality of beam structures according to claim 1, said beam structures being positioned parallel to each other.

14. Horizontal structure according to claim 13, characterized in that it comprises connection means to connect laterally at least two adjacent beam structures.

15. Horizontal structure, characterized in that it comprises at least one beam structure according to claim 1 positioned perpendicular to said plurality of beam structures and in a plane parallel to the latter.

16. Vertical structure characterized in that it comprises at least one plurality of beam structures according to claim 1, said beam structures being positioned parallel to each other.

17. Vertical structure according to claim 16, characterized in that it comprises connection means to connect laterally at least two adjacent beam structures.

18. Structure according to claim 14, characterized in that said connection means comprise at least one first tubular element (100) fixed transversely in the first (11) body of a beam structure, a second tubular element (100) fixed transversely in the first (11) or third (12) body of said adjacent beam structure, a bar (106) adapted to resist shear forces, disposed within said first and second tubular elements, a bonding agent (109) permitting connecting rigidly said bar, said first body of a beam structure, and the first or third body of said adjacent beam structure.

19. Construction characterized in that it comprises a horizontal structure and at least one vertical structure, each said structure being a beam structure according to claim 1.

20. Structure according to claim 17, characterized in that said connection means comprise at least one first tubular element (100) fixed transversely in the first (11) body of a beam structure, a second tubular element (100) fixed transversely in the first (11) or third (12) body of said adjacent beam structure, a bar (106) adapted to resist shear forces, disposed within said first and second tubular elements, a bonding agent (109) permitting connecting rigidly said bar, said first body of a beam structure, and the first or third body of said adjacent beam structure.

* * * * *